US006840138B2

(12) United States Patent
Graffin

(10) Patent No.: US 6,840,138 B2
(45) Date of Patent: Jan. 11, 2005

(54) DEVICE FOR SCREWING ON CAPS

(75) Inventor: André Graffin, Kuala Lumpur (MY)

(73) Assignee: Serac Group, La Ferta Bernard (FR)

( * ) Notice: Subject to any disclaimer, the term of this patent is extended or adjusted under 35 U.S.C. 154(b) by 17 days.

(21) Appl. No.: 10/413,467

(22) Filed: Apr. 15, 2003

(65) Prior Publication Data

US 2003/0196519 A1 Oct. 23, 2003

(30) Foreign Application Priority Data

Apr. 22, 2002 (FR) ..... 02 04985

(51) Int. Cl.[7] ..... B67B 7/00
(52) U.S. Cl. ..... 81/3.2; 81/467; 81/469
(58) Field of Search ..... 81/3.2, 467, 469

(56) References Cited

U.S. PATENT DOCUMENTS 4,172,397 A * 10/1979 Herbert ..... 81/3.2
4,773,289 A 9/1988 Graffin
5,271,296 A * 12/1993 Parent et al. ..... 81/3.2
5,647,254 A * 7/1997 Cook, Jr. ..... 81/467
5,787,770 A * 8/1998 Shimada et al. ..... 81/465
6,148,692 A * 11/2000 Russell ..... 81/3.2
6,182,534 B1 * 2/2001 Hardman ..... 81/3.2
6,651,531 B1 * 11/2003 Thornton ..... 81/3.2
2003/0070510 A1 * 4/2003 Tremblav ..... 81/3.2

FOREIGN PATENT DOCUMENTS

EP 0 677 482 A1 10/1995

* cited by examiner

*Primary Examiner*—James G. Smith
(74) *Attorney, Agent, or Firm*—Young & Thompson

(57) ABSTRACT

The device for screwing on a cap comprises a gripping head fixed to a rotary spindle, and a drive shaft connected to a drive member carried by a frame, the rotary spindle and the drive shaft are connected to each other on the same axis by a resilient coupling member, connected both to the rotary spindle and to the drive shaft, and the device further comprises a detector member for detecting relative rotation between the rotary spindle and the drive shaft, and a control member for interrupting tightening of the cap when the relative rotation reaches a predetermined threshold.

12 Claims, 2 Drawing Sheets

DEVICE FOR SCREWING ON CAPS

BACKGROUND OF THE INVENTION

Numerous devices are known for screwing on caps, and in particular a device comprising a gripping head fixed to a rotary spindle connected to a drive shaft via a friction clutch whose adhesion limit corresponds to the tightening torque that is to be applied to the caps. Because of the way that type of device operates, the clutch is designed to slip while each cap is being tightened, and that gives rise rapidly to wear on the friction elements, which requires the screwing-on device to be stopped frequently to tighten up the friction elements in order to obtain the desired torque.

A pneumatic device is also known that includes an actuator whose rod carries a rack connected via deflector pinions to a rotary spindle carrying the gripping head. The tightening torque is determined by the feed pressure of the pneumatic actuator and that pressure can be adjusted once and for all for a given cap tightening torque. However, because of the mechanism for deflecting the movement of the rack connected to the pneumatic actuator, that device is voluminous, which limits the number of cap screwing-on devices that can be installed on any one machine.

OBJECT OF THE INVENTION

An object of the present invention is to provide a cap screwing-on device offering good operating reliability and improved compactness.

BRIEF DESCRIPTION OF THE INVENTION

To this end, the invention provides a device for screwing on caps, which screwing-on device comprises a gripping head fixed to a rotary spindle, and a drive shaft connected to a drive member carried by a frame, the rotary spindle and the drive shaft are connected to each other on the same axis by a resilient coupling member, connected both to the rotary spindle and to the drive shaft, and the device further comprises a detector member for detecting relative rotation between the rotary spindle and the drive shaft, and a control member for interrupting rotation of the spindle when the relative rotation reaches a predetermined threshold.

Thus, since the drive shaft and the rotary spindle are mounted on the same axis, the device is compact, and since the drive shaft and the rotary spindle are coupled together continuously, the device can operate for a very large number of cycles without it being necessary to adjust the tightening torque again.

In a preferred embodiment of the invention, the resilient coupling member is a spring disposed between two abutments. It is then necessary merely to modify the force exerted by the spring in order to modify the tightening torque on the cap. Preferably, at least one of the abutments is adjustable, so that the force exerted by the spring is adjusted simply by adjusting the pre-stress on said spring.

In another advantageous aspect of the invention, the detector member comprises at least one disk having a position which is a function of a relative angular position between the drive shaft and the spindle, and a position sensor for detecting the position of the disk.

In yet another advantageous aspect of the invention, the gripping head comprises a housing fixed to the rotary spindle, a bell-shaped actuating member constrained to rotate with the housing and mounted to be movable axially relatively thereto, and gripping jaws mounted to move radially inside the actuating member, the actuating member and the jaws having ramps disposed facing one another to transform axial movement of the actuating member into radial movement of the gripping jaws.

BRIEF DESCRIPTION OF THE DRAWINGS

Other characteristics and advantages of the invention appear on reading the following description of a particular non-limiting embodiment of the invention with reference to the accompanying figures, in which.

DETAILED DESCRIPTION OF THE INVENTION

Figure 1:
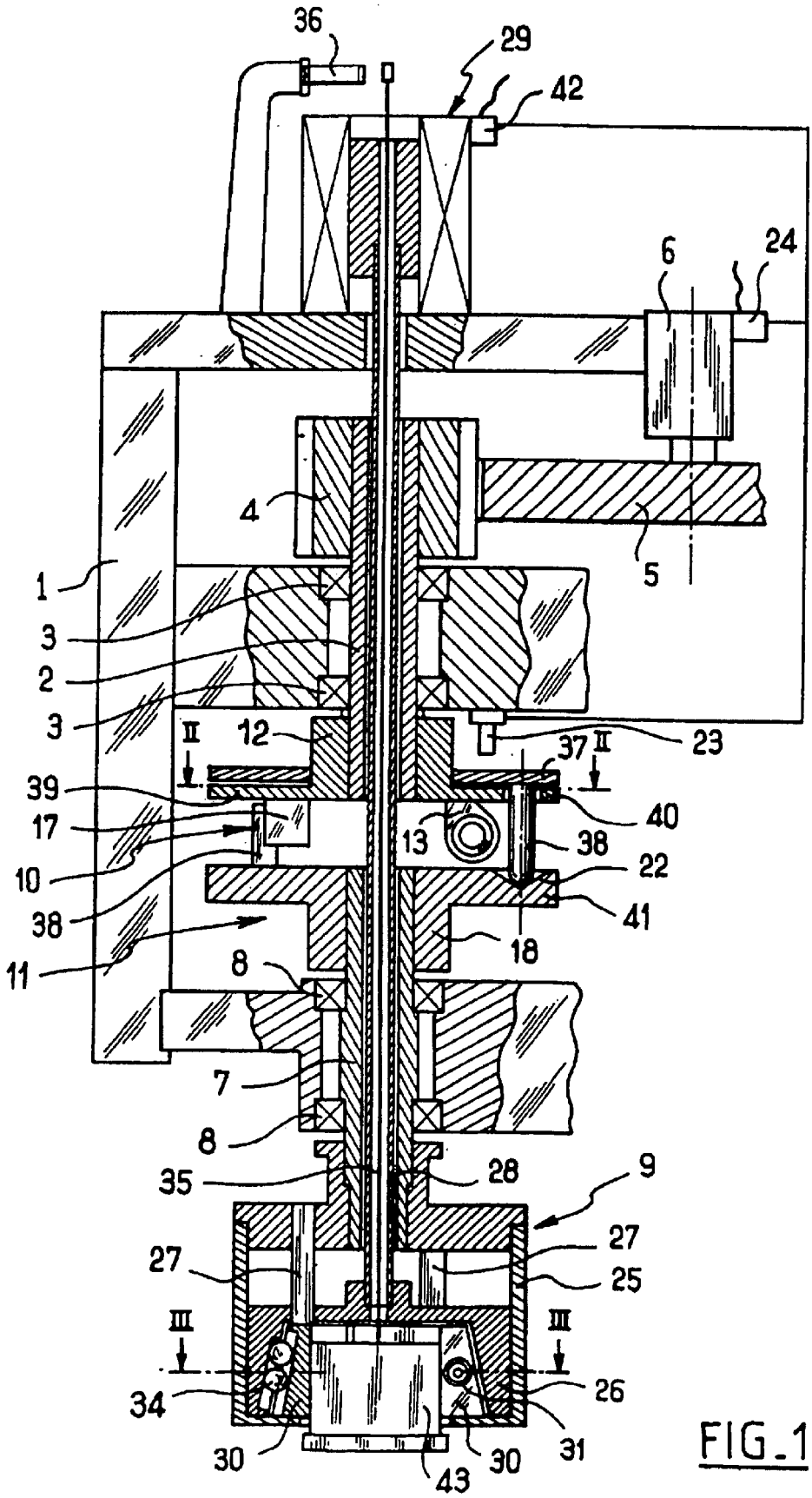
FIG. 1 is a diagrammatic view of the device of the invention when the jaws are in a closed position, the view being in section and on a vertical plane indicated by the lines I-I in FIGS. 2 and 3.

With reference to the figures, the device of the invention includes a frame 1 on which a drive shaft 2 is mounted to turn by means of bearings 3 carried by the frame. A drive cog 4 is mounted on the drive shaft 2 and is associated with a toothed wheel 5 which is itself connected to an electric motor 5 carried by the frame 1.

In addition, the frame 1 carries a rotary spindle 7 mounted on the frame via bearings 8 to turn on the same axis as the axis on which the drive shaft 2 turns. A gripping head 9 is fixed to the bottom end of the rotary spindle 7.

At its bottom end, the drive shaft 2 carries a coupling part 10, while, at its top end, the rotary spindle 7 carries a coupling part 11. As shown in the FIGS. 1 and 2, the coupling part 10 includes a hub 12 carrying an arm 13 on which a screw 14 is mounted that carries an abutment for one end of a spring 16. A blade 17 is fixed to the hub 12 and extends radially relative thereto. A plate 39 is fixed to the hub 12 perpendicularly thereto.

Figure 2:
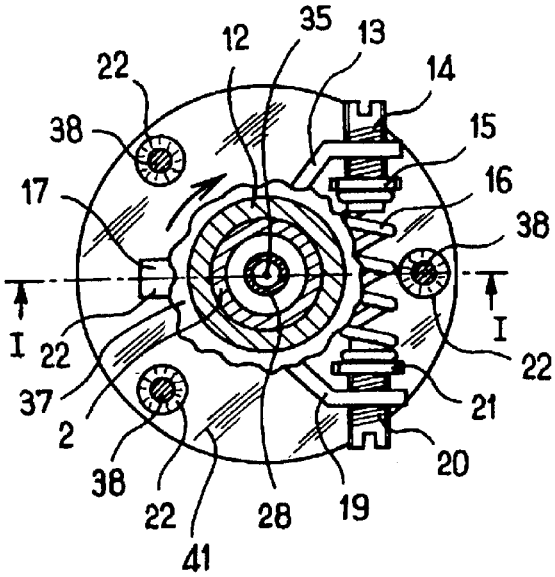
FIG. 2 is a view in section on line II-II of FIG. 1.

The coupling part 11 includes a hub 18 fixed to the top end of the rotary spindle 7. Substantially symmetrically to the arm 13, an arm 19 is fixed to the hub 18 and supports a screw 20 to which an abutment 21 is fixed for the second end of the spring 7. A blade 22 is also fixed to the hub 18 facing the blade 17. At rest, as shown in FIG. 2, the blades 17 and 22 are held together in mutual abutment under the effect of the spring 16.

A disk 37 is mounted on the hub 12 to move axially, and it is provided with three studs 38 that are spaced apart uniformly about the axis of the drive shaft 2, that extend parallel to said axis through holes 40 in the plate 39, and that abut against a plate 41 carried by the hub 18 of the coupling part 11. The disk 37 is thus constrained to rotate with the drive shaft 2 while also being movable axially relative thereto. The studs 38 abut against ramps formed by the walls of frustoconical notches 22 formed in the top face of the plate 41. A proximity detector 23 is carried by the frame 1 facing the disk 37 and it controls a switch 24 mounted on the power supply circuit of the drive motor 6.

Figure 3:
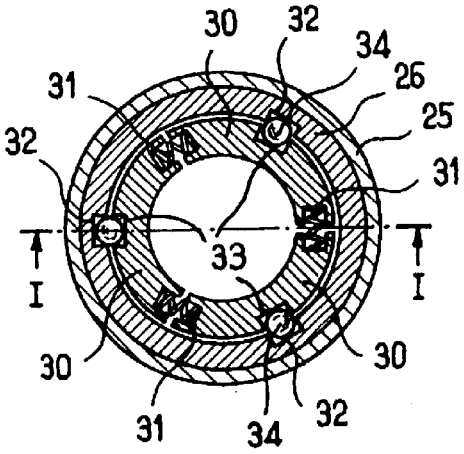
FIG. 3 is a view in section on line III-III of FIG. 1.

The gripping head 9 comprises a housing 25 in which a bell-shaped actuating member 26 is mounted. The actuating member is constrained to rotate with the housing 25 by means of pins 27 fixed to the housing and passing through the actuating member 26. The actuating member 26 is mounted to move axially on the pins 27. The actuating member 26 is connected via a hollow actuating rod 28 to an electromagnetic actuator 29 carried by the frame 1. The actuator 29 is provided with a switch 42 controlled by the detector 23. Three jaws 30 are mounted inside the actuating member 26, and they are spaced apart form each other by springs 31 disposed in recesses provided in the facing walls of two adjacent jaws (see FIG. 3).

The inside surface of the actuating member 26 and the outside surface of the jaws 30 are frustoconical, and they have ramps formed by the end-walls of sloping grooves, respectively 32 for the actuating member 26, and 33 for the jaws 30, which grooves receive coupling balls 34 which constrain the jaws 30 to rotate with the actuating member 26 while also enabling the actuating member 26 to move axially relative to the jaws 30. The jaws 30 are retained in an axial direction by the bottom ends of the pins 27 that extend facing the top edges of the jaws 30. For this purpose, the gripping head preferably has three pins 27 disposed at the same angular positions as the grooves 33.

In the preferred embodiment shown, the screwing-on device further includes a presence detector rod 35 which extends inside the hollow actuating rod 28 and which terminates above the actuator 29 facing a proximity detector 36 carried by the frame 1.

Figure 4:
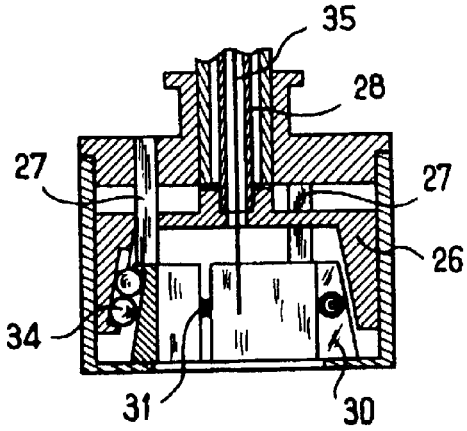
FIG. 4 is a view in section analogous to the FIG. 1 view of the gripping head when the jaws are in the open position.

At the beginning of a cycle, the drive motor 6 is off, and the jaws 30 are spaced apart from one another under the effect of the springs 31. The radial force exerted by the jaws 30 on the balls 34 pushes back the bell-shaped actuating member 26 of the gripping head 9 as shown by FIG. 4. The bottom end of the cap presence detector rod 35 for detecting the presence of caps extends between the jaws 30. When a cap 43 is inserted between the jaws 30, the cap presence detector rod 35 is pushed back upwards as shown in FIG. 1, and the proximity detector 36 triggers powering of the actuator 29 and of the drive motor 6. The actuator 29 being powered causes the bell-shaped actuating member 26 to move downwards, thereby causing the jaws 30 to move radially in a clamping direction. The rotary spindle 7 and the gripping head 9 that is associated with it are then caused to rotate in the tightening direction as indicated by the bold arrow in FIG. 2. At the beginning of rotation, the resistive torque on the cap is low so that the drive shaft 2 and the rotary spindle 7 form a united assembly that moves under the effect of the force exerted by the spring 16. When the resistive torque on the cap reaches the value of the drive torque exerted by the stress of the spring 16, the coupling part 10 rotates in a manner offset from the rotation of the coupling part 11, so that the studs 38 move in the frustoconical notches 22 and move the disk 37 upwards. When this movement reaches a predetermined threshold, the proximity detector 23 sends a signal to the switch 24 to switch off the drive motor 6 and to open the jaws 30 by ceasing to excite the actuator 29. The screwing-on device is then ready for a new screwing-on cycle.

Naturally, the invention is not limited to the embodiment described, and variant embodiments are possible without going beyond the ambit of the invention as defined by the claims.

In particular, although the coupling is illustrated by a compression spring 26 between the coupling part 10 secured to the drive shaft 2 and the coupling part 11 secured to the rotary spindle 7, it is possible to implement resilient coupling by any suitable means such as a torsion spring or even an elastomer sleeve disposed between the drive shaft and the rotary spindle.

Similarly, for detecting the angular offset between the drive shaft 2 and the rotary spindle 7, it is possible to use any suitable detection device, in particular an optical detection device, e.g. by fixing perforated disks to the drive shaft 2 and to the rotary spindle 7 and by detecting coincidence or offset between the perforations by means of photoelectric cells carried by the frame 1.

It is also possible to implement the invention by using a gripping head whose actuator is carried by the gripping head itself. It should be noted however that the device in the preferred embodiment of the invention operates without any friction contact being used, which constitutes a significant advantage in terms of the operating reliability of the device.

Although in the embodiment shown, the drive is provided by an electric motor 6, it is possible, in particular for a rotary screwing-on carrousel, to provide a stationary drive cog witch which the cog 4 is mounted to mesh, the frame 1 then being carried by a rotary platform rotated relative to the stationary cog. In which case, rotation of the gripping head 9 can be started and stopped by a clutch interposed at any point along the drive system for rotating the drive shaft 2. When the caps are relatively strong, it is also possible to keep the spindle rotating continuously, and to open the jaws of the gripping device as soon as the torque is reached, and to close them again when a new cap is detected. In which case, the switch 24 is omitted, and the detector 23 is connected to the switch 42 only.

What is claimed is:

1. A device for screwing on a cap, which screwing-on device comprises a gripping head fixed to a rotary spindle, and a drive shaft connected to a drive member carried by a frame, wherein the rotary spindle and the drive shaft are connected to each other on the same axis by a resilient coupling member, connected both to the rotary spindle and to the drive shaft, and wherein the device further comprises a detector member for detecting relative rotation between the rotary spindle and the drive shaft, and a control member for interrupting tightening of the cap when the relative rotation reaches a predetermined threshold.

2. A screwing-on device according to claim 1, wherein the resilient coupling member is a spring disposed between two abutments.

3. A screwing-on device according to claim 2, wherein at least one of the abutments is adjustable.

4. A screwing-on device according to claim 1, wherein the detector member comprises at least one disk having a position which is a function of a relative angular position between the drive shaft and the rotary spindle, and a position sensor for detecting the position of the disk.

5. A screwing-on device according to claim 4, wherein the disk is constrained to rotate with the drive shaft, while being mounted to move axially relative thereto, and is provided with positioning studs coming into abutment against ramps that are constrained to rotate with the rotary spindle.

6. A screwing-on device according to claim 5, wherein the ramp is formed by a frustoconical notch.

7. A screwing-on device according to claim 1, wherein the gripping head comprises a housing fixed to the rotary spindle, a bell-shaped actuating member constrained to rotate with the housing and mounted to be movable axially relatively thereto, and gripping jaws mounted to move radially inside the actuating member, the actuating member and the jaws having ramps disposed facing one another to transform axial movement of the actuating member into radial movement of the gripping jaws.

8. A screwing-on device according to claim 7, wherein the ramps are provided with grooves in which coupling balls are disposed.

9. A screwing-on device according to claim 7, wherein the rotary spindle is hollow, and wherein the actuating member is connected by an actuating rod extending inside the rotary spindle to an actuator carried by the frame of the device.

10. A screwing-on device according to claim 9, wherein the actuating rod is hollow and a cap presence detector rod extends inside the actuating rod to a detector carried by the frame.

11. A screwing-on device according to claim 1, wherein the control member for interrupting tightening of the cap is disposed to interrupt rotation of the drive shaft.

12. A screwing-on device according to claim 1, wherein the control member for interrupting tightening of the cap is disposed to cause the gripping head to open.

* * * * *